United States Patent [19]

Meitner et al.

[11] 4,426,417

[45] Jan. 17, 1984

[54] NONWOVEN WIPER

[75] Inventors: Gary H. Meitner, Winneconne, Wis.; Harry W. Hotchkiss, Marietta, Ga.

[73] Assignee: Kimberly-Clark Corporation, Neenah, Wis.

[21] Appl. No.: 479,417

[22] Filed: Mar. 28, 1983

[51] Int. Cl.[3] ..... B32B 3/00

[52] U.S. Cl. ..... 428/195; 428/156; 428/171; 428/172; 428/288; 428/296; 428/340; 428/903

[58] Field of Search ..... 428/156, 171, 172, 195, 428/288, 296, 340, 403

[56] References Cited

U.S. PATENT DOCUMENTS

| | | | |
|---|---|---|---|
| 3,016,599 | 1/1962 | Perry | 428/903 |
| 4,100,324 | 7/1978 | Anderson et al. | 428/326 |
| 4,279,979 | 7/1981 | Benson et al. | 428/903 |
| 4,286,977 | 9/1981 | Klein | 428/903 |
| 4,296,161 | 10/1981 | Haiser et al. | 428/171 |
| 4,307,143 | 12/1981 | Meitner | 428/156 |
| 4,328,279 | 5/1982 | Meitner et al. | 428/903 |
| 4,370,289 | 1/1983 | Sorenson | 264/113 |

*Primary Examiner*—James J. Bell

*Attorney, Agent, or Firm*—William D. Herrick; R. Jonathan Peters; Howard Olevsky

[57] ABSTRACT

Wiper comprising a matrix of nonwoven fibers having a basis weight generally in the range of from about 25 to 300 gsm and including a meltblown web having incorporated therein a staple fiber mixture including synthetic and cotton fibers. The combination provides highly improved wiping properties as well as strength and absorbency for many industrial applications requiring wiping of oily and/or aqueous materials. The wipers may be formed by a conventional meltblowing process involving extrusion of a thermoplastic polymer as filaments into airstreams which draw and attenuate the filaments into fine fibers having an average diameter of up to about 10 microns. The staple fiber mixture of synthetic and cotton fibers may be added to the airstream, and the turbulence produced where the airstreams meet results in uniform integration of the staple fiber mixture into the meltblown web. The matrix may contain up to 90% by weight of the synthetic and cotton fiber blend, which, itself, may contain up to about 90% by weight of the synthetic fibers.

12 Claims, 4 Drawing Figures

NONWOVEN WIPER

BACKGROUND OF THE INVENTION

1. Field of the Invention

The present invention relates to materials for the manufacture of nonwoven wipers particularly suited for industrial uses. Industrial wipers are currently either reusable cloth, in the form of manufactured wipers or rags, or nonwoven fabric material intended for disposable or limited use applications. The nonwoven material segment of this market has grown due to the economy of such products as well as the ability to tailor the wipers for specific applications. For example, nonwoven wipers are available having absorbency properties particularly suited for oil wiping, for food services wiping, and for wiping of high technology electronic parts. Such nonwoven wiper materials may be manufactured by a number of known processes including wet forming, air forming, and extrusion of thermoplastic fibers. The present invention is related to improvements in nonwoven wipers formed using a meltblowing process to produce microfibers and resulting wipers having utility and diverse applications, particularly where clean wiping properties are essential.

2. Description of the Prior Art

Meltblown nonwoven microfiber wiper materials are known and have been described in a number of U.S. Patents, including 4,328,279 to Meitner and Englebert dated May 4, 1982, U.S. Pat. Nos. 4,298,649 to Meitner dated Nov. 3, 1981, and 4,307,143 to Meitner dated Dec. 22, 1981. The preparation of thermoplastic microfiber webs is also known and described, for example, in Went, *Industrial and Engineering Chemistry,* Vol. 48, No. 8 (1956) pages 1342 through 1346, as well as in U.S. Pat. Nos. 3,978,185 to Buntin, et al. dated Aug. 31, 1976, 3,795,571 to Prentice dated Mar. 5, 1975, and 3,811,957 to Buntin dated May 21, 1974, for example. These processes generally involve forming a low viscosity thermoplastic polymer melt and extruding filaments into converging air streams which draw the filaments to fine diameters on the average of up to about 10 microns which are collected to form a nonwoven web. The addition of pulp to the air stream to incorporate pulp fibers into the meltblown fiber web is also known and described, for example, in U.S. Pat. No. 4,100,324 to Anderson, Sokolowski, and Ostermeier dated July 11, 1978. The incorporation of staple thermoplastic fibers into meltblown webs is further known and described, for example, in British Published Patent application No. 2,031,039A to Jacques dated Apr. 16, 1980, as well as earlier U.S. Pat. Nos. such as 2,988,469 to Watson dated Jun. 13, 1961 and 3,016,599 to Perry dated Jan. 16, 1962.

While wipers produced in accordance with the disclosures of these patents have, in some cases, achieved good acceptance for a number of wiping applications, it remains desired to produce a nonwoven wiper having extremely good clean wiping properties, i.e., the ability to wipe quickly leaving little or no streaks or residue. In addition, the pulp additive materials tend to be weak and linty and, therefore, unsuitable for many wiping applications. Further, it is desired to produce such a wiper at a cost consistent with disposability and having strength properties for rigorous wiping applications. The wipers of the present invention attain to a high degree these desired attributes and yet further improve the economies of the manufacture of nonwoven disposable wipers.

SUMMARY

The present invention relates to improved nonwoven wipers including thermoplastic microfibers having an average diameter in the range of up to about 10 microns. Further, the invention relates to such improved wipers having not only excellent clean wiping properties for aqueous liquids as well as low and high viscosity oils but also good tactile and physical properties such as strength, all achieved at further economies in the manufacture of such wipers. The wipers of the invention comprise a matrix of microfibers, preferably meltblown thermoplastic fibers having distributed throughout a staple fiber mixture of synthetic fibers and cotton fibers. The mixture or blend is present in an amount of up to about 90% by weight based on the total matrix weight, and the mixture contains up to 90% synthetic fibers based on the total weight of the mixture. Preferred embodiments include microfibers formed from polypropylene and a mixture of fibers including cotton and polyester staple. In a further preferred embodiment, the staple fibers have a denier in the range of up to about 6. Wipers of the invention are demonstrated to possess excellent clean wiping properties as determined by a wiping residual test as well as excellent absorbency for both oil and water as demonstrated by capillary suction tests and oil absorbency rate tests with both low and high viscosity oils. When compared with conventional wipers, wipers of the invention exhibit a unique combination of performance, physical properties, and economy of manufacture.

DESCRIPTION OF THE PREFERRED EMBODIMENTS

Figure 1:
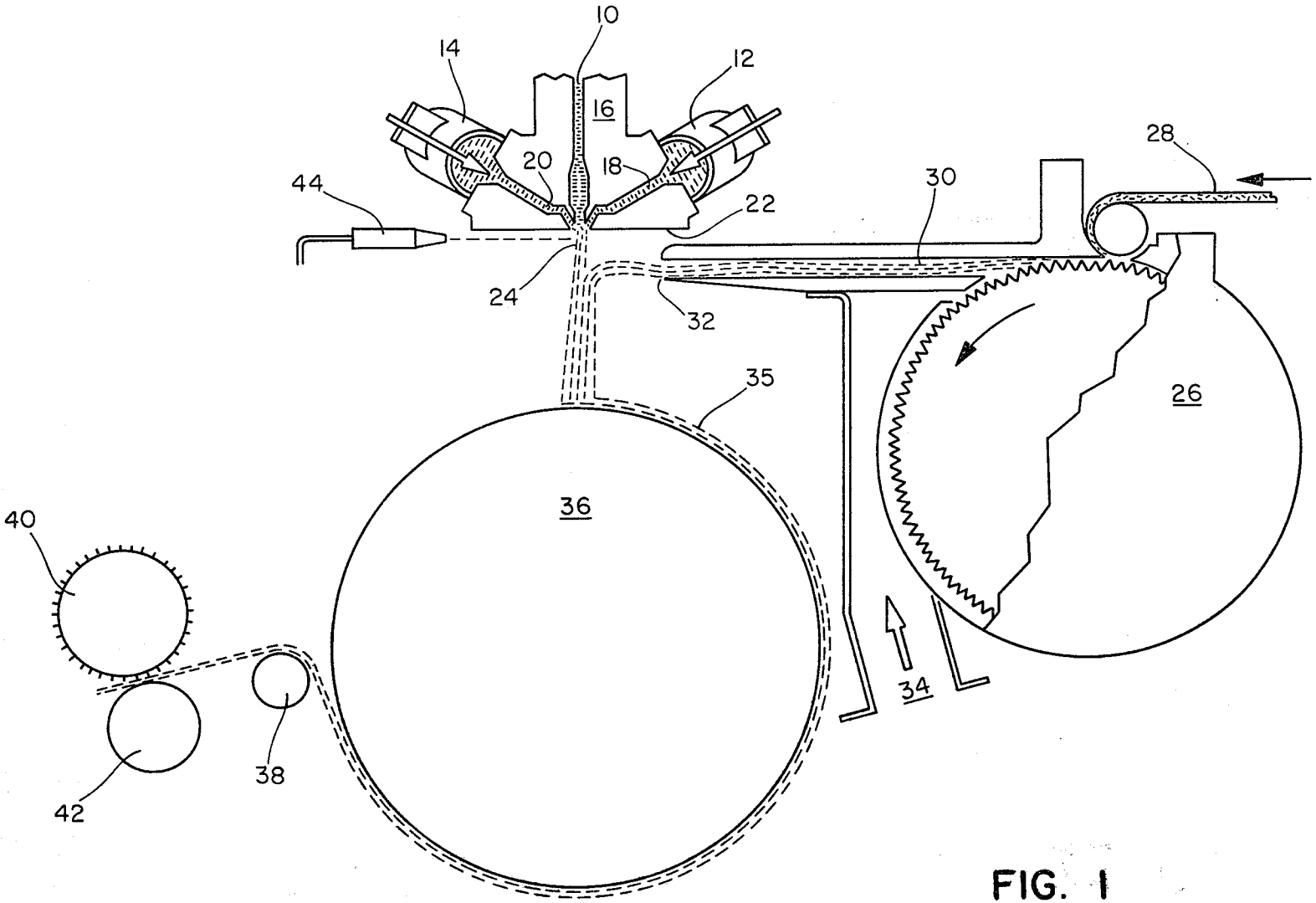
FIG. 1 is a schematic view of a process useful to prepare the webs of the present invention.

While the invention will be described in connection with preferred embodiments, it will be understood that it is not intended to limit the invention to those embodiments. On the contrary, it is intended to cover all alternatives, modifications, and equivalents as may be included within the spirit and scope of the invention as defined by the appended claims.

The invention will be described in reference to certain tests carried out on the material of the invention as well as conventional wipers. These tests were performed as follows:

Tensile results were obtained essentially in accordance with ASTMD-1117-74 . Samples 4" by 6" were prepared with five each having its length in the "machine" and "cross" directions. An Instron machine was used having one jaw face 1" square and the other 1" by 2" or larger with a longer dimension perpendicular to the direction of load. At a crosshead speed of 12" per minute, the full scale load was recorded and multiplied by a factor as follows: readings (pounds): 2, 5, 10, 20, 50; factors (respectively): 0.0048, 0.012, 0.024, 0.048, 0.120. The results were reported in energy (inches/pounds).

Capillary sorption pressure results were obtained essentially as described in Burgeni and Kapur "Capillary Sorbtion Equilibria in Fiber Masses", *Textile Research Journal,* May 1967, pages 356 through 366. A filter funnel was movably attached to a calibrated vertical post. The funnel was movable and connected to about 8 inches of capillary glass tubing held in a vertical position. A flat, ground 150 milliliter Buchner form fitted glass medium pyrex filter disc having a maximum pore diameter in the range of 10 to 15 microns supported the weighed sample within the funnel. The funnel was filled with Blandol white mineral oil having a specific gravity in the range of 0.845 to 0.860 and 60° F. from Whitco Chemical, Sonneborn Division, and the sample was weighed and placed under 0.5 psi pressure on the filter. After one hour during which the miniscus was maintained constant at a given height, starting at 35 to 45 centimeters, the sample was removed, weighed, and the grams per gram absorbed calculated. The height was adjusted and the process repeated with a new sample until a height of one centimeter was reached. Results were plotted in FIG. 3. In general, the results obtained below 20 centimeters oil indicate oil contained within web voids, and results obtained above 20 centimeters oil are significant as representing oil absorbed within the fibers, themselves, which is a factor in wiper retention.

Bulk was determined using an Ames bulk tester Model 3223 equipped with a long range indicator having 0–100 units with 0.001 inch graduation over a full span of 3 inches. A J50B (Wisconsin Bearing Company) universal joint was attached to the bottom of the vertical weight attachment rod and to the top of a 5 inches by 5 inches platen with total weight of 0.4 lb. ±0.01 lb. Ten 4 inches by 4 inches samples without folds or creases were stacked with the machine direction oriented in the same direction. The platen was centered over the stack and released gently. After 15 to 20 seconds, bulk was read to 0.001 inch, and the average of 5 tests reported.

Water absorption capacity was determined in accordance with Federal Specification UU-T-00595 (GSA-FSS) sections 4.4.4 and 4.4.5 using samples 4 inches by 4 inches.

Water or oil absorption rate was determined as follows: A sample 4 inches by 4 inches was held close to the surface of a distilled water or oil bath at least 4 inches deep maintained at 30° C. ±1° C.; the sample was dropped flat onto the water surface and the time (to the nearest 0.1 sec) measured until the sample was completely wetted. The test was repeated five times and the results averaged.

Water residue was determined as follows: 2 ml. water was placed on the surface to be tested, either stainless steel or nonwettable Formica resting on a top loaded balance and having a surface area 4 in. by 6 in.; a sample 4 in. by 6 in. was attached to a nonabsorbent flat surface above the surface to be tested, and the test surface raised to contact the sample at a pressure of 3 g/cm$^2$ for 5 seconds. The residue was recorded as the milligrams of water remaining on the test surface as an average of eight tests.

Detergent solution residue was determined in the same manner using a solution of water and 1% by weight Ivory nonionic liquid dishwashing detergent.

Oil residue was determined in the same manner using Blandol oil.

The meltblown fiber component of the matrix of the present invention may be formed from any thermoplastic composition capable of extrusion into microfibers. Examples include polyolefins such as polypropylene and polyethylene, polyesters such as polyethylene terephthalate, polyamides such as nylon, as well as copolymers and blends of these and other thermoplastic polymers. Preferred among these for economy as well as improved wiping properties is polypropylene. The synthetic staple fiber component may also be selected from these thermoplastic materials with polyester being preferred. The cotton component includes staple length cotton fibers. As used herein, "staple length" means fiber average length of ⅜ inch generally in the range of from about ¼ in. to ¾ in. and denier from about 1 to 1½. For economy, the staple fiber mixture of synthetic and cotton fibers is preferably obtained as bulk waste fiber which is available containing generally about 10% to 90% cotton fibers and 90% to 10% polyester fibers. These compositions, it will be recognized, may also contain minor amounts of other fibers and additives which will not adversely affect properties of the resulting wipers.

A process for making the wiper material of the present invention may employ apparatus as generally described in U.S. Pat. No. 4,100,324 to Anderson, Sokolowski and Ostermeier dated July 11, 1978 and, particularly, with respect to FIG. 1 thereof, which is incorporated herein by reference. In particular reference to FIG. 1 hereof, in general, a supply 10 of polymer is fed from an extruder (not shown) to die 16. Air supply means 12 and 14 communicate by channels 18 and 20 to die tip 22 through which is extruded polymer forming fibers 24. Picker 26 receives bulk waste fibers 28 and separates them into individual fibers 30 fed to channel 32 which communicates with air channel 34 and to the die tip 22. These fibers are mixed with meltblown fibers 24 and incorporated into matrix 35 which is compacted on forming drum 36 and directed over feed roll 38 for bonding between patterned roll 40 and anvil roll 42 after which the material may be cut into individual wipers or rolled and stored for later conversion. It will be recognized that, instead of feeding the polyester and cotton fibers as a mixture, the fibers may be fed individually to mix with meltblown fibers 24 at the exit of die tip 22.

The particular bond pattern is preferably selected to impart favorable textile-like tactile properties while providing strength and durability for the intended use. In general, embossing will take place at a pressure in the range of from about 130 pli to about 500 pli, preferably at least 150 pli for 14% bond area. For a different bond area, the preferred pressure may be obtained by multiplying by the ratio of % areas to maintain constant p.s.i. on an individual bond point. The temperature will generally be in the range of from about 180° F. to 325° F. and preferably about 260° F. where the meltblown fibers are polypropylene and the synthetic fibers are polyester, for example. The bond pattern will preferably result in individual embossments over 5% to 30% of the material surface with individual bonds in the range of from about 20 to 200 bonds/in$^2$.

When rapid fiber quenching is desired, the filaments 24 may be treated by spray nozzle 44, for example, during manufacture. The material may be treated for water wettability with a surfactant as desired. Numerous useful surfactants are known and include, for example, anionic and ionic compositions described in U.S. Pat. No. 4,307,143 to Meitner issued Dec. 22, 1981. For most applications requiring water wettability, the surfactant will be added at a rate of about 0.15% to 1.0% by weight on the wiper after drying.

Figure 2:
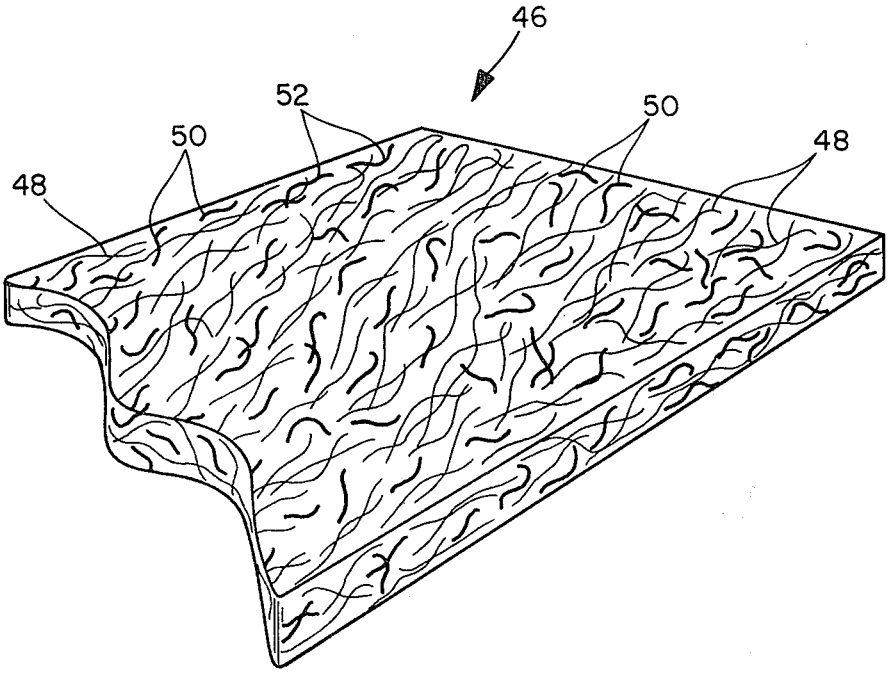
FIG. 2 is an enlarged view in partial cross section of an unbonded wiper web produced in accordance with the invention.

Turning to the schematic illustration in FIG. 2, an embodiment of the wiper material of the present invention will be described. As shown prior to embossing for purposes of clarity, wiper 46 is formed from a generally uniform mixture of microfibers 48 with staple cotton fibers 50 and staple polyester fibers 52. While it is not desired to limit the invention to any specific theory, it is believed that the improved performance is obtained by the staple polyester and staple cotton fibers separating the fine microfibers and producing voids for absorption of liquids. Furthermore, the nature of the cotton fibers is believed to contribute to improved texture, wettability and clean wiping properties. Depending upon the particular properties desired for the wiper, the percentage of staple cotton fibers in the mixture with polyester staple may vary in the range of up to about 90% by weight with the range of from about 30% to 70% by weight preferred. This mixture may be added to the microfibers in an amount within the range of up to about 90% mixture by weight with the range of from about 40% to 80% preferred. In general, the greater the amount of the staple synthetic and staple cotton fiber mixture added, the more improved will be the clean wiping capacity properties.

The total basis weight will also vary depending upon the desired wiper application but will normally be in the range of from about 25 to 300 grams per square meter and, preferably, in the range of from about 65 to 150 grams per square meter.

EXAMPLES

The invention will now be described with reference to specific examples.

EXAMPLE 1

Using apparatus assembled generally as described in FIG. 1 having a picker setting of feed roll to nose bar clearance of 0.003 in., nosebar to picker distance of 0.008 in. and picker speed of 320 RPM, polypropylene was extruded at barrel pressure of 200–350 PSIG at a temperature of about 640° F. to 760° F. to form microfibers with primary air at about 630° F. to 715° F. at a fiber production rate of 1.2 to 2.3 PIH. To these microfibers in the attenuating air stream was added about 50% by weight of a mixture of staple polyester fibers and cotton fibers (Product No. A1122 Leigh Textiles, nominally a 50/50 weight % mixture) at a rate of 1.2 to 2.3 PIH. The resulting matrix was bonded by heat and pressure conditions of 260° F. and 20 psi in a pattern covering about 14% of the surface area with about 140 bonds per square inch. The material had a basis weight of 95.95 grams per square yard and a bulk of 0.054 inch. It was soft and conformable and had excellent tactile properties.

EXAMPLE 2

Example 1 was repeated except that yellow pigment (Ampaset 43351) was added at about 0.7% by weight. The resulting material had a basis weight of 102.33 grams per square yard and a bulk of 0.045 inch.

EXAMPLE 3

For comparison, Example 1 was repeated except that the mixture of cotton and staple fibers was replaced with a supply of pulp fibers. The resulting material had a basis weight of 81.98 grams per square yard and a bulk of 0.056 inch. Example 3A is a similar sample of two layers of about 1.5 oz/yd$^2$ of a mixture of pulp and meltblown polypropylene fibers, one layer on each side of an about 0.4 oz./yd$^2$ reinforcing spunbonded polypropylene layer.

EXAMPLE 4

Also for comparison, Example 1 was repeated without the addition of fibers to produce a pure meltblown polypropylene web. This material had a basis weight of 89.41 grams per square yard and a bulk of 0.032 inch.

EXAMPLES 5 THROUGH 8

Example 1 was repeated except that a fiber blend (nominally 50/50 weight %) designated A141M was used and the ratio of staple mixture to meltblown microfibers was varied as follows: 30/70, 40/60, 50/50, and 60/40.

EXAMPLES 9 THROUGH 11

Example 1 was repeated except that the denier of the polyester in the staple cotton fiber mixture was varied from 15, to 6, to 3 denier.

The materials of Examples 1 through 11 were tested for wiping and certain physical properties and are reported in the Table I which follows. For comparison tests were also made of a wiper containing staple fibers only added to meltblown. microfibers (Example 12), standard shop towels (Example 13), terrycloth bar towels (Example 14), paper wipers (Example 15), spunbonded material alone (Example 16), heavier basis weight meltblown material alone (Example 17), spunbonded/meltblown/spunbonded laminate wiper material (Example 18), a laminate of Example 3 material between two spunbonded layers (Example 19), polyester wiper material (Example 20) and carded web wipers (Example 21).

Figure 3:
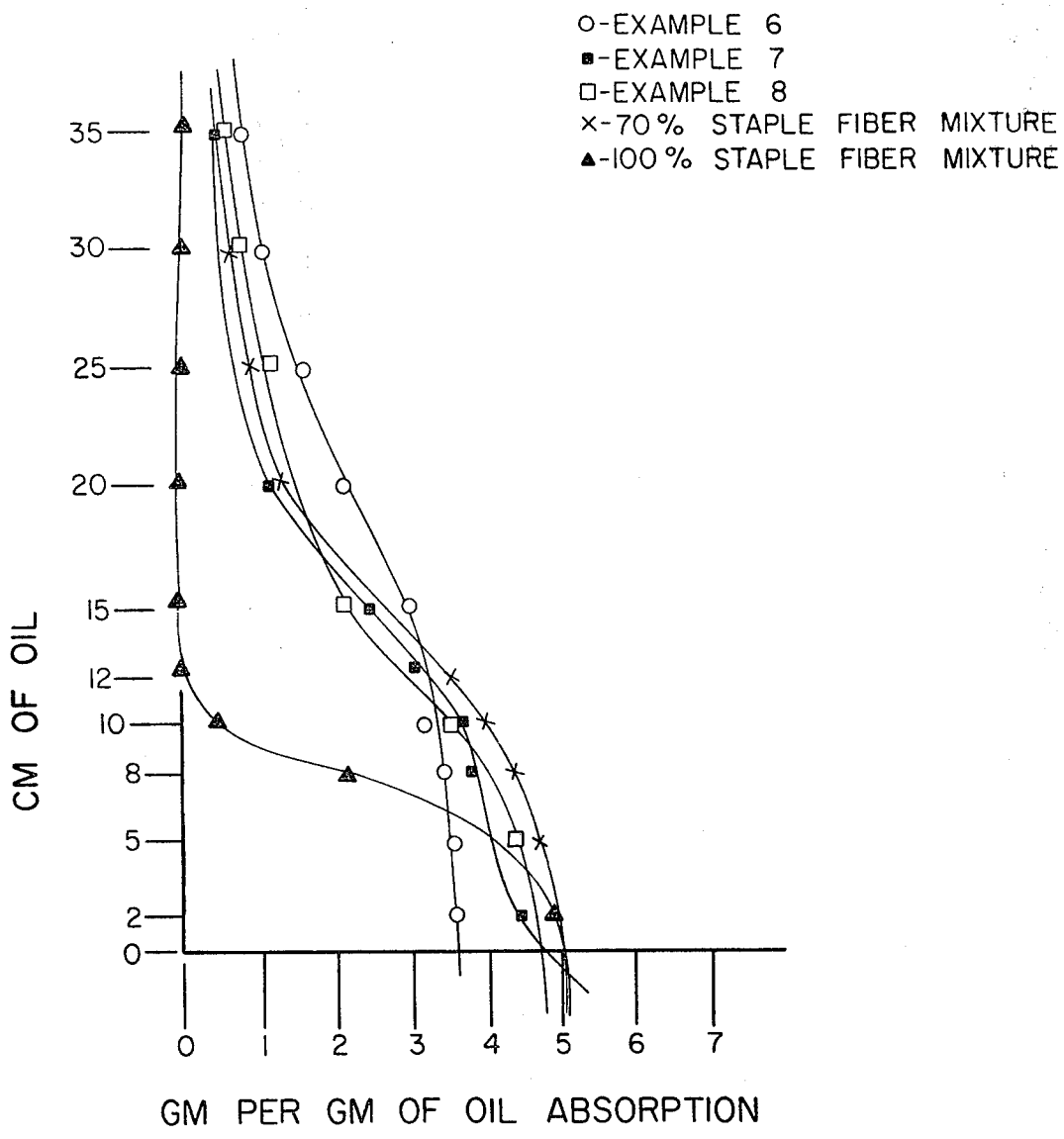
FIG. 3 is a graph comparing capillary suction results obtained on wipers incorporating a range of stable fiber compositions.

FIG. 3 demonstrates by capillary suction curves that the wiper materials of the present invention exhibit properties unexpected considering the curves for the individual components separately tested. Thus, the oil absorbed is much higher for the materials of the present invention except at the lowest oil pressures.

Figure 4:
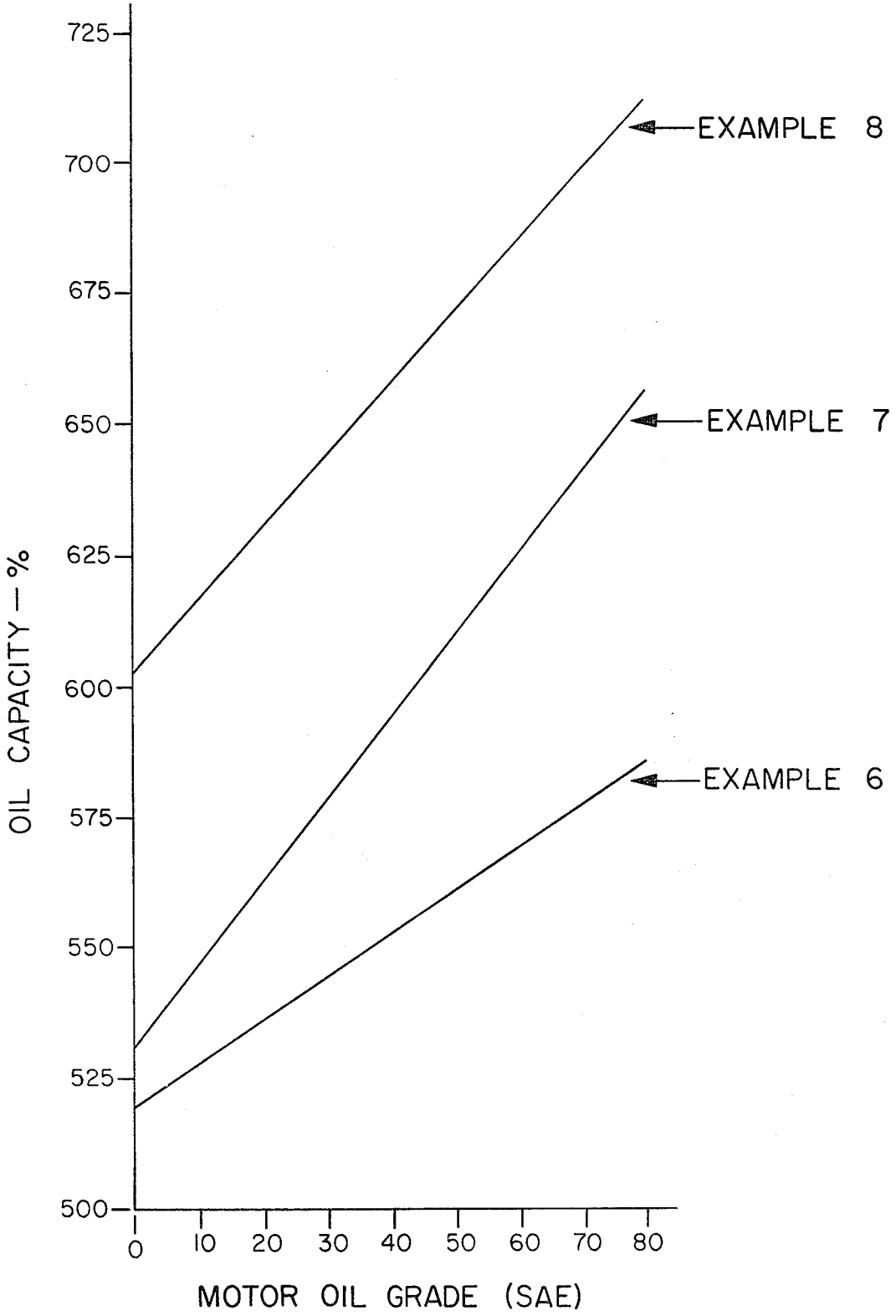
FIG. 4 is a graph of oil absorbency capacity for different viscosity oils comparing blends of staple fibers of varying proportions.

Turning to FIG. 4, it can be seen that oil capacity increases with increasing amounts of staple fiber and values of at least about 500% are readily obtained. The materials tested contained 60%, 50% and 40% staple mixture by weight based on the combined weight and basis weights of 108.69, 116.44 and 89.71 g/m$^2$, respectively. They were tested with 10, 30 and 80 W motor oil.

TABLE I

| | EXAMPLE | | | | | | | | | | | |
|---|---|---|---|---|---|---|---|---|---|---|---|---|
| | 1 | 2 | 3 | 3A | 4 | 5 | 6 | 7 | 8 | 9 | 10 | 11 |
| TEST | | | | | | | | | | | | |

TABLE I-continued

| | | | | | | | | | | | | |
|---|---|---|---|---|---|---|---|---|---|---|---|---|
| Water Absorbtion | | | | | | | | | | | | |
| Capacity (%) | 793 | 560 | 972 | 751 | 435 | 534 | 520 | 591 | 648 | 631 | 638 | 675 |
| Rate (Seconds) | 1.99 | 1.07 | 1.10 | 1.16 | 3.40 | | | | | | | |
| Oil Absorbtion | | | | | | | | | | | | |
| Capacity (%) | 677 | 506 | 810 | 618 | 414 | 405 | 500 | 530 | 565 | 596 | 527 | 547 |
| Rate (Seconds) | 3.99 | 7.37 | 2.73 | 3.19 | 18.87 | | | | | | | |
| Dry Water Residue: (mg) | | | | | | | | | | | | |
| 1 Layer - Formica | 65 | 9 | 75 | 33 | 113 | | | | | | | |
| 1 Layer - St. Steel | 45 | 14 | 69 | 25 | 77 | | | | | | | |
| 4 Layer - Formica | 22 | 4 | 16 | 12 | 1 | | | | | | | |
| 4 Layer - St. Steel | 3 | 1 | 24 | 8 | 2 | | | | | | | |
| Wet Sample Water Residue: (mg) | | | | | | | | | | | | |
| 1 Layer - Formica | 12 | 69 | 21 | 14 | 583 | | | | | | | |
| 1 Layer - St. Steel | 12 | 97 | 3 | 27 | 493 | | | | | | | |
| 4 Layer - Formica | 4 | 0 | 12 | 0 | 25 | | | | | | | |
| 4 Layer - St. Steel | 3 | 1 | 3 | 0 | 13 | | | | | | | |
| 1% Ivory Solution Residue: (mg) | | | | | | | | | | | | |
| 1 Layer | 62 | 261 | | | | 471 | 345 | 251 | 316 | 470 | 251 | 178 |
| 4 Layer | | | | | | | | | | | | |
| Oil Residue: (mg) | | | | | | | | | | | | |
| 1 Layer | 55 | 48 | | | 130 | | | | | | | |
| 4 Layer | | 33 | | | 45 | | | | | | | |
| Basis Wt. (g/m$^2$) | 96.0 | 122.4 | 98.3 | 124.2 | 106.9 | 106.9 | 114.8 | 112.8 | 100.2 | 115.5 | 105.3 | 99.2 |
| Tensile Strength (g) | | | 1022 | | | 4490 | 3538 | 3265 | 2950 | | | |
| Thickness (cm) | 0.137 | 0.114 | 0.142 | | 0.081 | | | | | 0.005 | 0.005 | 0.005 |
| Bulk Density g/cm$^3$ | 7.004 | 10.736 | 6.905 | | 13.0 | | | | | | | |

| | EXAMPLE | | | | | | | | | |
|---|---|---|---|---|---|---|---|---|---|---|
| | 12 | 13 | 14 | 15 | 16 | 17 | 18 | 19 | 20 | 21 |
| TEST | | | | | | | | | | |
| Water Absorbtion | | | | | | | | | | |
| Capacity (%) | 243 | 272 | 412 | 782 | 396 | | 422 | 642 | | 593 |
| Rate (Seconds) | 00 | | 0.64 | 0.80 | | | 25.10 | 1.41 | | 49.52 |
| Oil Absorbtion | | | | | | | | | | |
| Capacity (%) | 1571 | 289 | 300 | 563 | 357 | | 362 | 512 | | 342 |
| Rate (Seconds) | 3.10 | 11.53 | 1.05 | 4.19 | 17.30 | | 22.15 | 4.21 | | 44.30 |
| Dry Water Residue: (mg) | | | | | | | | | | |
| 1 Layer - Formica | 1895 | 1643 | 0 | 6 | 1750 | | 429 | 36 | 1153 | 209 |
| 1 Layer - St. Steel | 1852 | 1579 | 0 | 1 | | | 510 | 69 | 692 | 153 |
| 4 Layer - Formica | 1895 | 1643 | 0 | 1 | 1750 | | 380 | 12 | 691 | 17 |
| 4 Layer - St. Steel | 1852 | 1579 | 0 | 0 | | | 16 | 25 | 515 | 62 |
| Wet Sample Water Residue: (mg) | | | | | | | | | | |
| 1 Layer - Formica | 1216 | 733 | 2 | 149 | | | 651 | 50 | 335 | 47 |
| 1 Layer - St. Steel | 774 | 1020 | 64 | 167 | 1111 | | 803 | 42 | 210 | 21 |
| 4 Layer - Formica | 1235 | 44 | 0 | 4 | | | 128 | 0 | 4 | 5 |
| 4 Layer - St. Steel | 708 | 30 | 0 | 3 | 734 | | 265 | 0 | 1 | 0 |
| 1% Ivory Solution Residue: (mg) | | | | | | | | | | |
| 1 Layer | | 207 | 13 | | 949 | 269 | 548 | 56 | | |
| 4 Layer | | | 25 | | 202 | 7 | 39 | 9 | | |
| Oil Residue: (mg) | | | | | | | | | | |
| 1 Layer | | 80 | | | | | 250 | 53 | | |
| 4 Layer | | | | | | | 61 | 41 | | |
| Basis Wt. (g/m$^2$) | 69.5 | 180.5 | 378.9 | 87.7 | 62.2 | 120.0 | 89.2 | 126.3 | | 44.1 |

To demonstrate improved oil absorbtion rates obtainable in accordance with the present invention, tests were performed on materials having varying proportions of blend and microfiber components and using various weight or viscosity oils. The results are shown in the following Table II and illustrate that in all but one case the rate improved with increasing blend addition and the improvement was even more significant with the higher weight oils.

TABLE II

| | Oil Absorption Rate (Sec.) | | | |
|---|---|---|---|---|
| | Motor Oil Grade (SAE) | | | |
| Blend/Meltblown | 10 | 20 | 50 | 85 |
| 40/60 | 3.55 | 3.59 | 11.86 | 28.33 |
| 50/50 | 2.61 | 3.18 | 8.17 | 20.74 |

TABLE II-continued

| | Oil Absorption Rate (Sec.) | | | |
|---|---|---|---|---|
| | Motor Oil Grade (SAE) | | | |
| Blend/Meltblown | 10 | 20 | 50 | 85 |
| 60/40 | 2.67 | 2.32 | 8.07 | 16.21 |

As is demonstrated by the above examples, the wiper material of the present invention provides a unique combination of excellent wiping properties for different liquids including oils of various viscosities with strength and appearance contributing to an improved wiper at substantial economies resulting from the ability to incorporate reprocessed fibers containing cotton and polyester. It is thus apparent that there has been provided, in accordance with the invention, a wipe material that fully satisfies the objects, aims and advantages set forth above. While the invention has been described in conjunction with the specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. An improved nonwoven wiper comprising a matrix of fibers having a total basis weight in the range of from about 25 to 300 grams per square meter including a web of thermoplastic microfibers having an average diameter in the range of up to about 10 microns and having distributed throughout said web a mixture of synthetic staple fibers and cotton fibers, said mixture being present in an amount up to 90% by weight based on the total matrix weight and containing up to 90% synthetic staple fibers based on the total weight of the mixture.

2. The wiper of claim 1 wherein the thermoplastic microfibers are polypropylene.

3. The wiper of claim 2 wherein the synthetic staple fibers are predominantly polyester.

4. The wiper of claim 1 pattern bonded over about 5 to 30% of its surface with a bond frequency of about 20 to 200 bonds per square inch.

5. The wiper of claim 1 pattern bonded over about 5 to 30% of its surface with a line pattern having a frequency of about 2 to 15 lines per inch.

6. The wiper of claim 2 pattern bonded over about 5 to 30% of its surface with a bond frequency of about 20 to 200 bonds per square inch.

7. The wiper of claim 2 pattern bonded over about 5 to 30% of its surface with a line pattern having a frequency of about 2 to 15 lines per inch.

8. The wiper of claim 1 treated with a surfactant in the range of from about 0.15 to 1.0% by weight.

9. The wiper of claim 1 wherein the denier of the synthetic staple fibers is in the range of up to about 6.

10. The wiper of claim 1 wherein the thermoplastic microfibers are nylon.

11. Nonwoven wiper having an oil capacity of at least about 500% and total basis weight in the range of from about 25 to 300 grams per square meter comprising a fiber matrix including thermoplastic microfibers having an average diameter in the range of up to about 10 microns having distributed throughout said matrix a mixture of cotton fibers and polyester staple fibers containing up to about 90% of the polyester staple fibers and wherein said mixture is present in an amount of up to about 90% by weight, said matrix being pattern bonded over about 5 to 30% of its surface area and including about 0.25 to 1.0% surfactant.

12. The wiper of claim 11 wherein said microfibers are polypropylene and wherein said bond pattern is 20 to 200 bonds per square inch.

* * * * *